US008398430B1

(12) United States Patent
Queru

(10) Patent No.: US 8,398,430 B1
(45) Date of Patent: Mar. 19, 2013

(54) MULTI-ORIENTATION PLUG

(75) Inventor: Jean Baptiste Maurice Queru, Foster City, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/156,488

(22) Filed: Jun. 9, 2011

Related U.S. Application Data

(60) Provisional application No. 61/452,269, filed on Mar. 14, 2011.

(51) Int. Cl.
*H01R 13/60* (2006.01)

(52) U.S. Cl. ..... 439/536

(58) Field of Classification Search ..... 439/535–536, 439/218, 107, 136
See application file for complete search history.

(56) References Cited

U.S. PATENT DOCUMENTS

| | | | | |
|---|---|---|---|---|
| 3,523,269 | A | 8/1970 | Witek, Jr. et al. | |
| RE31,017 | E | 8/1982 | Bernstein | |
| 4,379,606 | A | 4/1983 | Clark et al. | |
| 4,457,570 | A | 7/1984 | Bogese, II | |
| 4,566,749 | A | 1/1986 | Johnston | |
| 4,648,682 | A | 3/1987 | Tubbs | |
| 4,759,726 | A | 7/1988 | Naylor et al. | |
| 4,873,479 | A | 10/1989 | Iimura et al. | |
| 4,978,317 | A | 12/1990 | Pocrass | |
| 5,061,203 | A | 10/1991 | Allgood et al. | |
| 5,501,608 | A | 3/1996 | Scheer et al. | |
| 5,605,473 | A | 2/1997 | Kishon | |
| 5,626,488 | A | 5/1997 | Albeck et al. | |
| 5,876,237 | A | 3/1999 | Patel et al. | |
| 5,975,940 | A | 11/1999 | Hartmann et al. | |
| 6,027,365 | A | 2/2000 | Kaufman | |
| 6,086,395 | A * | 7/2000 | Lloyd et al. | 439/172 |
| 6,116,963 | A | 9/2000 | Shutter | |
| 6,183,306 | B1 | 2/2001 | Caveney | |
| 6,190,190 | B1 | 2/2001 | Daly et al. | |
| 6,193,560 | B1 | 2/2001 | Morana et al. | |
| 6,210,236 | B1 | 4/2001 | Kan | |
| 6,261,120 | B1 | 7/2001 | Beege et al. | |
| 6,290,538 | B1 | 9/2001 | Pocrass | |
| 6,558,203 | B2 | 5/2003 | Pocrass | |
| D478,310 | S | 8/2003 | Andre et al. | |
| 6,669,495 | B2 * | 12/2003 | Philips et al. | 439/170 |
| 6,756,543 | B1 | 6/2004 | Kaloustian | |
| 6,770,815 | B1 | 8/2004 | Shotey et al. | |
| 6,893,297 | B2 | 5/2005 | Chen | |
| D519,922 | S | 5/2006 | Andre et al. | |
| 7,084,727 | B2 | 8/2006 | Bauer et al. | |

(Continued)

FOREIGN PATENT DOCUMENTS

| | | |
|---|---|---|
| DE | 4332068 | 3/1994 |
| DE | 19528410 | 2/1996 |

(Continued)

*Primary Examiner* — Jean F Duverne
(74) *Attorney, Agent, or Firm* — Morris & Kamlay LLP

(57) ABSTRACT

An electrical adapter assembly includes a housing defining a cutout, the housing including first electrical contacts and second electrical contacts disposed within the cutout. The electrical adapter assembly includes (i) a plug including a body having a first portion extending from an edge of a second portion, the first portion extending generally orthogonal to the second portion, (ii) electrical prongs extending from the first portion, and (iii) electrical contacts coupled to the electrical prongs. The body of the plug is receivable in the cutout in at least two orientations, and in each of the at least two orientations, one or more of the electrical contacts of the plug engage at least one of the first electrical contacts or at least one of the second electrical contacts.

18 Claims, 11 Drawing Sheets

U.S. PATENT DOCUMENTS

| | | | | |
|---|---|---|---|---|
| 7,329,143 | B2 | 2/2008 | Schrader | |
| 7,766,689 | B2 * | 8/2010 | Knoerrchen et al. | 439/437 |
| D638,356 | S | 5/2011 | Chen | |
| 2003/0076204 | A1 * | 4/2003 | Whipple et al. | 335/202 |
| 2004/0118620 | A1 * | 6/2004 | Fringeli et al. | 177/180 |
| 2004/0248457 | A1 | 12/2004 | Walter | |
| 2005/0000719 | A1 | 1/2005 | Shotey et al. | |
| 2005/0042929 | A1 | 2/2005 | Ng | |
| 2005/0270130 | A1 | 12/2005 | Roesner et al. | |
| 2007/0178747 | A1 | 8/2007 | Schrader | |
| 2009/0305565 | A1 | 12/2009 | Stiehl et al. | |
| 2009/0305578 | A1 | 12/2009 | Lim et al. | |
| 2010/0173514 | A1 | 7/2010 | Chiang et al. | |
| 2011/0225812 | A1 | 9/2011 | Deluliis et al. | |
| 2011/0227535 | A1 | 9/2011 | Caskey et al. | |

FOREIGN PATENT DOCUMENTS

| | | |
|---|---|---|
| DE | 19946568 | 4/2001 |
| DE | 10137497 | 5/2003 |
| DE | 10152347 | 6/2003 |
| DE | 10241198 | 8/2003 |
| DE | 10236790 | 10/2003 |
| DE | 102005023452 | 11/2006 |
| DE | 202006013824 | 10/2007 |
| EP | 0219570 | 4/1987 |
| EP | 0980124 | 2/2000 |

* cited by examiner

MULTI-ORIENTATION PLUG

CROSS REFERENCE TO RELATED APPLICATION

This application claims priority to U.S. Provisional Application No. 61/452,269, filed on Mar. 14, 2011. The entire contents of U.S. Provisional Application No. 61/452,269 are incorporated herein by reference.

TECHNICAL FIELD

The present specification relates to power adapters.

BACKGROUND

Power adapters are commonly used to power a variety of electrical devices. For example, radios, phones, notebook computers, and other devices frequently receive power from a power adapter that connects to an electrical outlet. Although power adapters provide users the ability to use their electrical devices and recharge batteries, many power adapters are awkward to use.

SUMMARY

A removable plug can be coupled to a power adapter in multiple orientations. A user can select the orientation of the plug relative to the power adapter housing so that the power adapter assembly fits in the space constraints of a particular electrical outlet. For example, the electrical prongs can extend from one side when connecting to a wall outlet, and the electrical prongs can extend from a different side to connect to a socket of a power strip.

In one general aspect, an electrical adapter assembly includes: a housing defining a cutout, the housing including first electrical contacts and second electrical contacts disposed within the cutout; and a plug including a body having a first portion extending from an edge of a second portion, the first portion extending generally orthogonal to the second portion, electrical prongs extending from the first portion, and electrical contacts coupled to the electrical prongs, the body of the plug being receivable in the cutout in at least two orientations, and in each of the at least two orientations, one or more of the electrical contacts of the plug engage at least one of the first electrical contacts or at least one of the second electrical contacts.

Implementations may optionally include one or more of the following features. For example, the electrical prongs extend outward from the housing when the body of the plug is received in the cutout. The at least two orientations include a first orientation and a second orientation, in the first orientation, the electrical contacts of the plug establish an electrical connection with the first electrical contacts and the second portion of the body of the plug is disposed over the second electrical contacts, and in the second orientation, the electrical contacts of the plug establish an electrical connection with the second electrical contacts and the second portion of the body of the plug is disposed over the first electrical contacts. The housing has a first side oriented orthogonal to a second side, and in the first orientation, the electrical prongs extend in a direction orthogonal to the first side of the housing, and in the second orientation, the electrical prongs extend in a direction orthogonal to the second side of the housing. The body of the plug includes a third portion extending generally orthogonal to the first portion and the second portion, the housing further includes third electrical contacts disposed within the cutout, and the body of the plug is receivable in the cutout in at least three orientations, and in each of the at least three orientations, one or more of the electrical contacts of the plug engage at least one of the first electrical contacts, at least one of the second electrical contacts, or at least one of the third electrical contacts.

Implementations may also optionally include one or more of the following features. For example, the at least three orientations include a first orientation, a second orientation, and a third orientation, and (i) in the first orientation, the electrical contacts of the plug establish an electrical connection with the first electrical contacts, the second portion of the body is disposed over the second electrical contacts, and the third portion of the body is disposed over the third electrical contacts, (ii) in the second orientation, the electrical contacts of the plug establish an electrical connection with the second electrical contacts, the second portion of the body is disposed over the third electrical contacts, and the third portion of the body is disposed over the first electrical contacts, and (iii) in the third orientation, the electrical contacts of the plug establish an electrical connection with the third electrical contacts, the second portion of the body is disposed over the first electrical contacts, and the third portion of the body is disposed over the second electrical contacts.

In another general aspect, a power adapter includes: a housing defining a cutout, the housing having a first surface disposed within the cutout and a second surface disposed within the cutout, the first surface being generally orthogonal to the second surface; first electrical contacts disposed at the first surface; second electrical contacts disposed at the second surface, and the housing is configured to receive a body of a plug in the cutout in at least two orientations such that in each of the at least two orientations, an electrically conductive connection is established with the plug and at least one of the first electrical contacts or at least one of the second electrical contacts.

Implementations may optionally include one or more of the following features. For example, the power adapter includes adapter circuitry located in the housing, and the adapter circuitry is configured to receive electrical input from both the first electrical contacts and the second electrical contacts. The first electrical contacts and the second electrical contacts are electrically connected such that voltages applied to the first electrical contacts are transmitted to the second electrical contacts, and voltages applied to the second electrical contacts are transmitted to the first electrical contacts. The first electrical contacts protrude from the first surface and the second electrical contacts protrude from the second surface. The cutout is defined in a corner of the housing. The housing includes a cube-shaped portion disposed in the cutout, the cube-shaped portion including the first surface, the second surface, and a third surface oriented orthogonal to the first surface and the second surface. The housing has a third surface disposed within the cutout, the third surface being generally orthogonal to the first surface and the second surface, the power adapter further includes third electrical contacts disposed at the third surface, the housing is configured to receive a body of a plug in the cutout in at least three orientations such that in each of the at least three orientations, an electrically conductive connection is established between the plug and at least one of the first electrical contacts, at least one of the second electrical contacts, or at least one of the third electrical contacts.

In another general aspect, a member having a first portion extending from an edge of a second portion, the first portion extending generally along a first plane and the second portion extending along a second plane generally orthogonal to the first plane, the first portion having a first side and a second side opposite the first side; electrical prongs coupled to the first side of the first portion; and electrical contacts coupled to the electrical prongs.

Implementations may optionally include one or more of the following features. For example, the first portion defines one or more first recesses, and the second portion defines one or more second recesses having approximately the same dimensions as the first recesses, and the electrical contacts are disposed in the first recesses or the second recesses. The second portion has a first side and a second side opposite the first side, the second side of the first portion and the second side of the second portion generally forming a right angle, and the first recesses are defined in the second side of the first portion and the second recesses are defined in the second side of the second portion. The body defines an edge where the second side of the first portion meets the second side of the second portion, and the first recesses and the second recesses are defined with symmetry across the edge. The plug includes a moveable cover configured to cover the electrical contacts when the electrical plug is not coupled to a power adapter, and configured to not cover the electrical contacts when the electrical plug is coupled to a power adapter.

Implementations may also optionally include one or more of the following features. The member has a third portion extending from an edge of the first portion and a second edge of the second portion, the third portion extending along a third plane generally orthogonal to the first plane and the second plane. The third portion has a first side and a second side opposite the first side; the first portion defines one or more first recesses, and the second portion defines one or more second recesses having approximately the same dimensions as the first recesses, and the third portion defines one or more third recesses having approximately the same dimensions as the first recesses; the electrical contacts are disposed in the first recesses, the second recesses, or the third recesses; and the first recesses, the second recesses, and the third recesses are defined with symmetry across one or more edges, the edges being defined between any two of the second side of the first portion, the second side of the second portion, and the second side of the second portion.

Advantageous implementations can include one or more of the following features. An electrical plug can be coupled to a power adapter in at least two orientations. The plug can be coupled to the electrical adapter so that electrical prongs of the plug extend from different sides of the power adapter in different orientations.

The details of one or more implementations are set forth in the accompanying drawings and the description below. Other features and advantages will become apparent from the description, the drawings, and the claims.

BRIEF DESCRIPTION OF THE DRAWINGS

Like reference numbers and designations in the various drawings indicate like elements.

DETAILED DESCRIPTION

A power adapter receives a removable plug in at least two orientations. The various orientations of the plug permit a user to change the orientation of the plug relative to the power adapter. For example, in one orientation, the electrical prongs extend from a first side of the power adapter. In another orientation, the electrical prongs extend from a second side of the power adapter. A user can move the electrical plug from one orientation to another to permit the power adapter to make best use of the space around an electrical outlet. If the power adapter does not fit at an electrical outlet in one orientation, the user can reposition the electrical plug to another orientation to allow the power adapter to be plugged into the outlet.

Figure 1A:
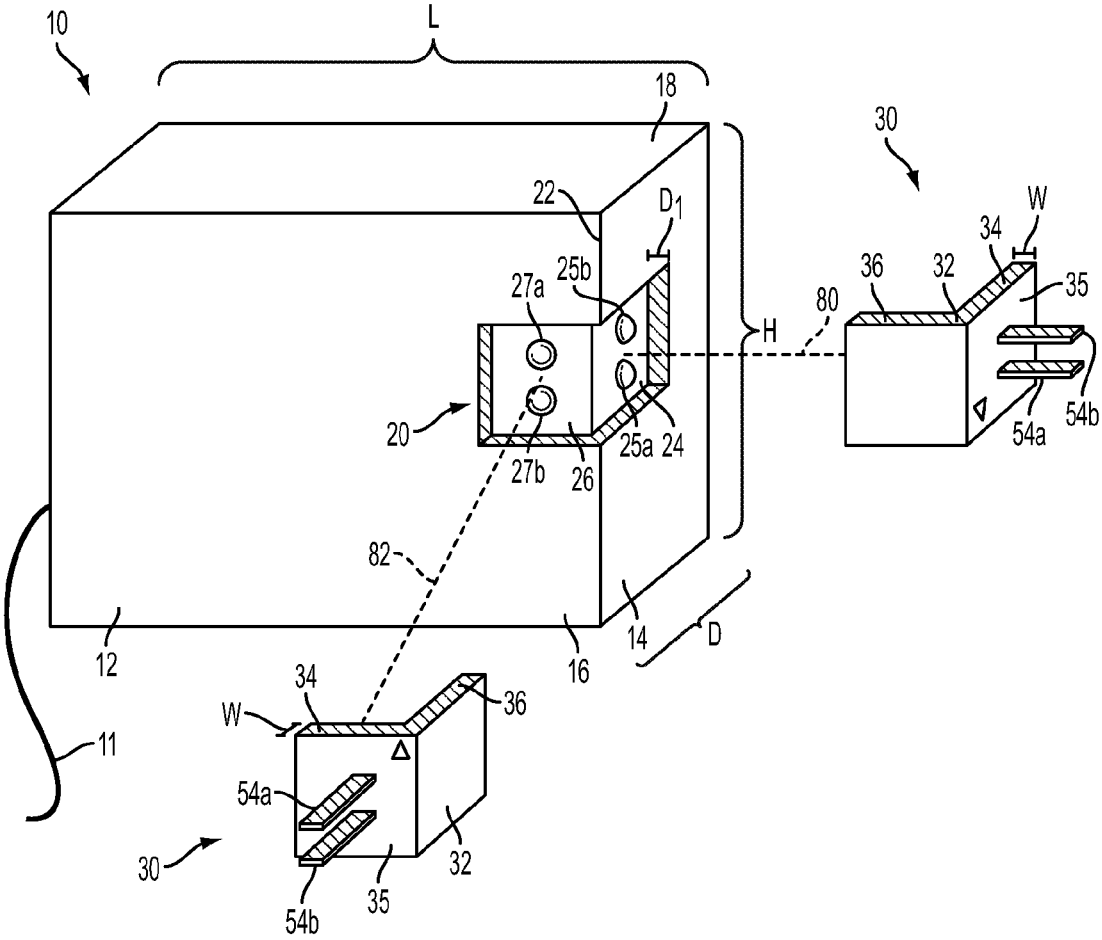
FIG. 1A is a perspective view of a power adapter and an electrical plug.
Figure 1B:
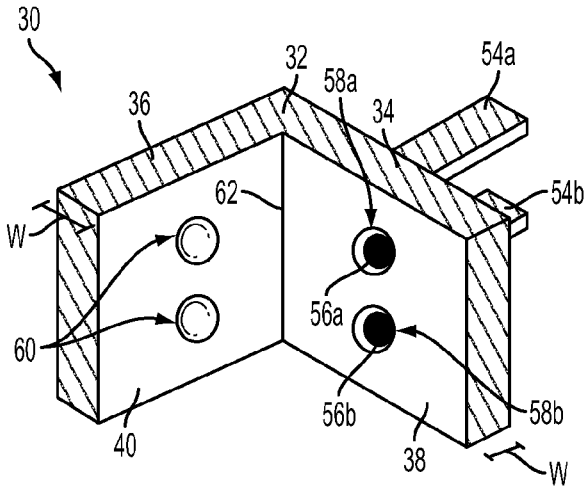
FIG. 1B is a perspective view of the electrical plug of FIG. 1A.

FIG. 1A is a perspective view of a power adapter 10 and an electrical plug 30. FIG. 1B is a perspective view of the electrical plug 30 of FIG. 1A. The power adapter 10 receives the plug 30 in at least two different orientations. In each of the orientations, an electrically conductive connection is established between the power adapter 10 and the plug 30. When coupled, the power adapter 10 and the electrical plug 30 form an electrical adapter assembly 90 (FIGS. 2A and 2B) that can be connected to an electrical outlet to supply power to an electrical device. As used herein, an electrical connection refers generally to an electrically conductive path established between two elements, whether or not current is flowing or a voltage is applied. The path can occur, for example, due to physical engagement of electrically conductive elements or through intervening circuitry without direct engagement.

The power adapter 10 includes adapter circuitry (not shown), which can be located within a housing 12. The adapter circuitry can, for example, convert an alternating current (AC) input voltage to a direct current (DC) output voltage. An output cable 11 can be coupled to the power adapter 10 to provide DC power to an electrical device, such as a cellular phone, laptop computer, or media playing device.

The housing 12 includes generally flat sides 14, 16, 18 oriented generally perpendicular to each other such that the housing 12 has a block-like shape. The housing 12 can have a length, L, longer than the height, H, which is longer than the depth, D. Because the dimensions of the housing 12 can be unequal, different orientations of the housing 12 relative to a power outlet can have different clearance requirements. For example, when the first side 14 is parallel to an outlet, the length, L, of the power adapter 10 will extend perpendicular to the outlet. By contrast, when the second side 16 is parallel to the power adapter 10, the depth, D, will extend perpendicular to the outlet. As a result, different orientations of the power adapter 10 relative to an outlet have different space requirements.

The housing 12 defines a cutout 20 in which to receive the plug 30. The cutout 20 is defined at an edge 22 of the housing 12 where the two perpendicular sides 14, 16 meet. The cutout 20 extends through a portion of both of the sides 14, 16, and is generally symmetrical about the edge 22.

The shape and size of the cutout 20 are selected to approximate the shape and size of a body 32 of the plug 30. For example, the depth of the cutout $D_1$ is approximately equal to the width, W, of a first portion 34 and a second portion 36 of the body 32 of the plug 30. In each of the sides 14, 16, the cutout 20 has a shape that generally matches the shape of the first portion 34 and the second portion 36 of the body 32 of the plug 30 (e.g., generally rectangular or square), permitting the body 32 to be received in the cutout 20 (see FIGS. 2A and 2B). The cutout 20 can have other shapes and sizes depending on the geometry of the plug 30.

Within the cutout 20, the housing 12 includes a first surface 24 disposed generally parallel to the first side 14 and a second surface 26 oriented generally parallel to the second side 16. The first surface 24 and the second surface 26 are generally flat to engage a generally flat first inner surface 38 and a generally flat second inner surface 40 (FIG. 1B) of the body 32 of the plug 30. In some implementations, the first surface 24 and the second surface 26 can be contoured or angled to engage the inner surfaces 38, 40 of the body 32, which may not be flat or precisely perpendicular.

At the first surface 24, the power adapter 10 includes first electrical contacts 25*a*, 25*b*. At the second surface 26, the power adapter 10 includes second electrical contacts 27*a*, 27*b*. The first electrical contacts 25*a*, 25*b* and the second electrical contacts 27*a*, 27*b* can each include multiple contacts, for example, one contact for a phase (e.g., active or live AC) connection, and another contact for a return (e.g., neutral) connection. Additional contacts can be included, for example, to permit a connection to ground or to permit other electrical connections. The first electrical contacts 25*a*, 25*b* and the second electrical contacts 27*a*, 27*b* protrude from their respective surfaces 24, 26. When the plug 30 is detached from the power adapter 10, the power adapter 10 is not connected to AC power and contact with the exposed first electrical contacts 25*a*, 25*b* and second electrical contacts 27*a*, 27*b* is not dangerous. In some implementations, the first electrical contacts 25*a*, 25*b* and the second electrical contacts 27*a*, 27*b* can be flush with or can be recessed into the surfaces 24, 26.

The first electrical contacts 25*a*, 25*b* and the second electrical contacts 27*a*, 27*b* are coupled to the adapter circuitry, and are configured to receive AC power. The first electrical contacts 25*a*, 25*b* and second electrical contacts 27*a*, 27*b* can both be connected to the adapter circuitry such that electrical power applied to either the first electrical contacts 25*a*, 25*b* or the second electrical contacts 27*a*, 27*b* is transmitted to the adapter circuitry.

The first electrical contacts 25*a*, 25*b* and the second electrical contacts 27*a*, 27*b* are electrically connected to each other so that power applied to the first electrical contacts 25*a*, 25*b* also connects power to the second electrical contacts 27*a*, 27*b*, and vice versa. Thus an electrical connection to either the first electrical contacts 25*a*, 25*b* or the second electrical contacts 27*a*, 27*b* will supply power to the adapter circuitry. Alternatively, in some implementations, the first electrical contacts 25*a*, 25*b* and the second electrical contacts 27*a*, 27*b* can be electrically isolated from each other and still be coupled to the adapter circuitry.

The electrical plug 30 includes the body 32, electrical prongs 54*a*, 54*b*, and electrical contacts 56*a*, 56*b*. The body 52 includes the first portion 34 that extends from an edge 42 of the second portion 36. The first portion 34 extends generally perpendicular to the second portion 36, such that the body 32 has a generally L-shaped cross-section. The outer surface 35 of the first portion 34 and the outer surface 37 of the second portion 36 are generally square, corresponding to the size of the cutout 20. The width, W, of the first portion 34 and the second portion 36 is generally the same as the depth, $D_1$, of the cutout 20, so that the outer surfaces 35, 37 are flush with the sides 14, 16 of the housing 12 when the body 32 is received in the cutout 20.

The electrical prongs 54 extend from the outer surface 35 of the first portion 34 of the body 32. The electrical prongs 54 can extend generally perpendicular to the surface 35. The electrical prongs 54 can include, for example, two or more prongs for insertion into an AC power outlet.

Referring to FIG. 1B, the plug 30 includes electrical contacts 56*a*, 56*b* at the first inner surface 38, opposite the electrical prongs 54. Each of the electrical contacts 56*a*, 56*b* is electrically connected to one of the electrical prongs 54*a*, 54*b* (for example, through a wire or conductor in the first portion 34), so that voltage applied to the electrical prongs 54 is transmitted to the electrical contacts 56*a*, 56*b*. Additionally, or alternatively, one or more electrical contacts can be located at the inner surface 40 and can be electrically connected to the electrical prongs 54*a*, 54*b*.

The electrical contacts 56*a*, 56*b* are disposed in recesses 58*a*, 58*b* in the first inner surface 38 of the first portion 34. The recesses 58*a*, 58*b* admit the first electrical contacts 25*a*, 25*b* or the second electrical contacts 27*a*, 27*b*, depending on the orientation of the plug 30 relative to the power adapter 10. The second portion 36 defines recesses 60 that admit the first electrical contacts 25*a*, 25*b* or the second electrical contacts 27*a*, 27*b* (again depending on the orientation of the plug 30 relative to the power adapter 10), but the recesses 60 do not include electrical contacts. The recesses 60 can be defined symmetrically relative to the recesses 58*a*, 58*b* across an inner edge 62 located between the first inner surface 38 and the second inner surface 40. For example, the recesses 60 can have reflectional symmetry across the inner edge 62 (such that the recesses 60 and the recesses 58*a*, 58*b* are mirror images of each other) or rotational symmetry (such that the position of the recesses 60 is rotationally offset relative to the position of the recesses 58*a*, 58*b* by, for example, 180 degrees), or both.

In addition, or alternatively, electrical contacts can be included in the recesses 60. In some implementations, electrical contacts can be located in each of the recesses 58*a*, 58*b*, 60. As a result, the power adapter 10 can include only one set of electrical contacts in the cutout 20 and still be able to establish an electrical connection (e.g., establish an electrically conductive path) with the plug 50 in multiple orientations.

Referring to FIGS. 1A and 1B, when the plug 30 is coupled to the power adapter 10, either the first electrical contacts 25*a*, 25*b* or the second electrical contacts 27*a*, 27*b* enter the recesses 58*a*, 58*b* and engage the electrical contacts 56*a*, 56*b*, establishing an electrically conductive connection. Whichever of the first electrical contacts 25*a*, 25*b* or the second electrical contacts 27*a*, 27*b* did not enter the recesses 58*a*, 58*b* enter the recesses 60. As a result, the electrical contacts 25*a*, 25*b*, 27*a*, 27*b*, which protrude from the surfaces 24, 26, will not impede the surfaces 24, 26 from resting against the infer surfaces 38, 40 of the plug 30.

Because the electrical contacts 56*a*, 56*b* are disposed within the recesses 58*a*, 58*b*, the possibility that a user accidently touches the electrical contacts 56*a*, 56*b* while the electrical prongs 54 are connected to AC power is less than if the electrical contacts 56*a*, 56*b* were flush with or protrude from the inner surface 38. The plug 30 can include one or more safety features that further limit accidental exposure to AC power, such as fuses, circuit breakers, switches, and current limiters. The plug 30 can also include one or more safety features that, for example, block the electrical contacts 56*a*, 56*b* from accidental exposure to a user. An example of a safety mechanism is described in greater detail with reference to FIGS. 5A and 5B.

The plug 30 can be coupled to the power adapter 10 in at least two orientations. Although the power adapter 10 receives only one plug 30 at a time, the plug 30 is shown in two positions in FIG. 1A to illustrate two different orientations.

Figure 2A:
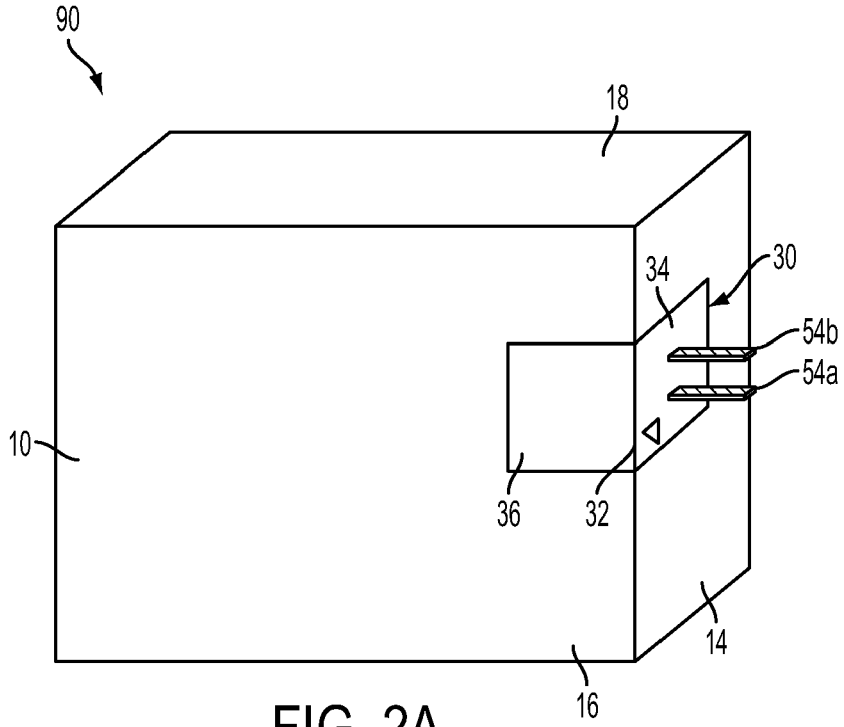
FIGS. 2A and 2B are perspective views of the electrical plug coupled to the power adapter in two different orientations.

In the first orientation, the electrical contacts 56*a*, 56*b* are aligned with the first electrical contacts 25*a*, 25*b*, for example, along a first axis 80. To couple the plug 30 to the power adapter 10 in the first orientation, the user moves the body 32 of the plug 30 into the cutout 20. The electrical contacts 56*a*, 56*b* engage the first electrical contacts 25*a*, 25*b* of the power adapter 10, forming an electrical connection that connects the electrical prongs 54*a*, 54*b* to the adapter circuitry through the first electrical contacts 25*a*, 25*b*. The second portion 36 of the body 32 covers the second electrical contacts 27*a*, 27*b*, which are received in the recesses 60. The electrical prongs 54*a*, 54*b* extend from the side 14 of the housing 12, as shown in FIG. 2A.

The plug 30 and the power adapter 10 form a power adapter assembly 90 that can be used to power electrical devices. The prongs 54*a*, 54*b* can be inserted into an electrical outlet so that the power adapter 10 provides power to one or more electrical devices. Because the second electrical contacts 27*a*, 27*b* are covered by the body 32 of the plug 30, the second electrical contacts 27*a*, 27*b* do not expose a user to AC power.

Figure 2B:
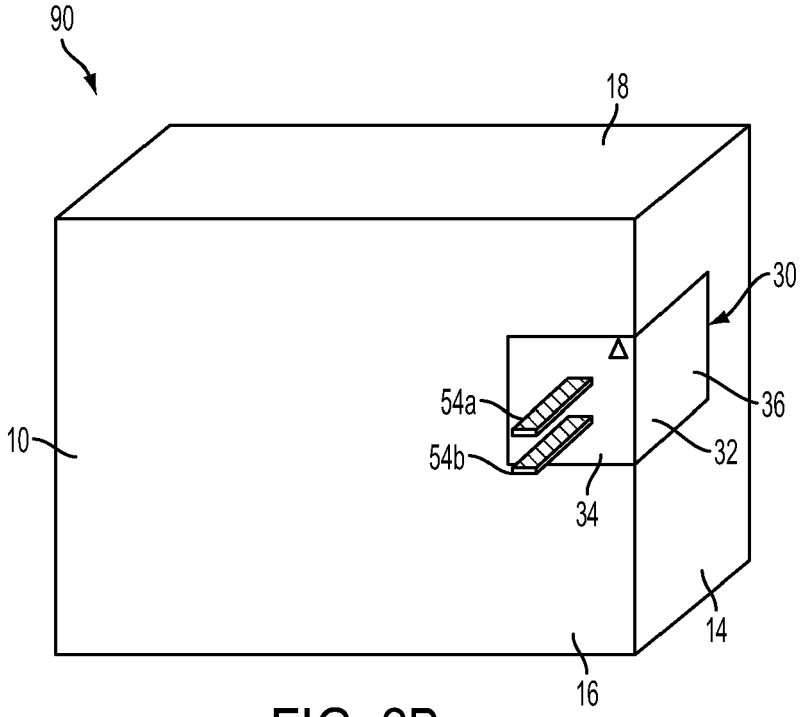

The plug 30 can be removed from the power adapter 10 and replaced in a second orientation relative to the power adapter 10. In the second orientation, the electrical contacts 56*a*, 56*b* of the plug 30 are aligned with the second electrical contacts 27*a*, 27*b*, for example, along a second axis 82. To couple the plug 30 to the power adapter 10 in the second orientation, the user moves the body 32 of the plug 30 into the cutout 20 so that the electrical contacts 56*a*, 56*b* engage the second electrical contacts 27*a*, 27*b* of the power adapter 10. This forms an electrical connection between the electrical prongs 54*a*, 54*b* and the adapter circuitry through the second electrical contacts 27*a*, 27*b*. In the second orientation, the second portion 36 of the body 32 covers the first electrical contacts 25*a*, 25*b*, and the electrical prongs 54*a*, 54*b* extend from the side 16 of the housing 12, as shown in FIG. 2B.

Because the electrical prongs 54*a*, 54*b* extend from different sides 14, 16 of the housing 12 during in the first and second orientations, the user can change the orientation of the plug 30 relative to the power adapter 10 to select the most advantageous orientation for a particular use. For example, in the first orientation, shown in FIG. 2A, the prongs 54*a*, 54*b* extend in a direction parallel to the length, L, of the housing 12. In the first orientation, for example, the power adapter assembly 90 can be used with a power strip in which multiple electrical outlets are arranged in a row. With the prongs 54*a*, 54*b* inserted in an outlet of a power strip, the length, L, of the housing extends upward so that the housing 12 does not obscure adjacent electrical outlets.

In the second orientation, the prongs 54*a*, 54*b* are oriented perpendicular to the side 16, the largest side of the power adapter 10. In the second orientation, the power adapter assembly 90 can be used at an electrical outlet in a wall. The housing 12 can extend parallel to the wall to avoid interfering with furniture or people passing by.

In addition, the power adapter 10 and the plug 30 maintain polarity during the first and the second orientations. Due to the arrangement of the first electrical contacts 25*a*, 25*b* and the second electrical contacts 27*a*, 27*b*, the adapter circuitry receives the same electrical input regardless of the orientation of the plug 30. For example, the contact 25*a* and the contact 27*a* are electrically connected, and the contact 25*b* and the contact 27*b* are electrically connected. The contact 25*b* is located above the contact 25*a* at the surface 24. By contrast, the position of the contacts 27*a*, 27*b* is reversed. Contact 27*a* is located above the contact 27*b* at the surface 26.

In the first orientation, the contact 56*a* connects to the contact 25*a*, and in the second orientation, the contact 56*a* connects to the contact 27*a*. Even though the orientation of the plug 30 changes between the first orientation and the second orientation, the same prong 54*a* will be connected to a particular input to the adapter circuitry (whether through contact 25*a* or contact 27*a*) in both the first orientation and the second orientation. Similarly, the prong 54*b* will connect to either the contact 25*b* or the contact 27*b* regardless of the orientation of the plug 30 to the power adapter 10, thus maintaining polarity of the input to the adapter circuitry.

FIGS. 3A to 3E are perspective views illustrating repositioning the electrical plug 30 from a first orientation (FIG. 3A) to a second orientation (FIG. 3E) relative to the power adapter 10. To change the orientation, the user first disconnects the power adapter assembly 90 from an AC power source.

From the first orientation, the user removes the plug 30 from the power adapter 10. In some implementations, the housing 12 defines a notch or groove that permits the user to pry the plug 30 out of the cutout 20. In other implementations, the power adapter 10 includes a release mechanism, such as a latch or a switch that releases a fastening mechanism that secures the plug 30 to the power adapter 10, allowing to the plug 30 to become uncoupled from the power adapter 10.

Figure 3A:
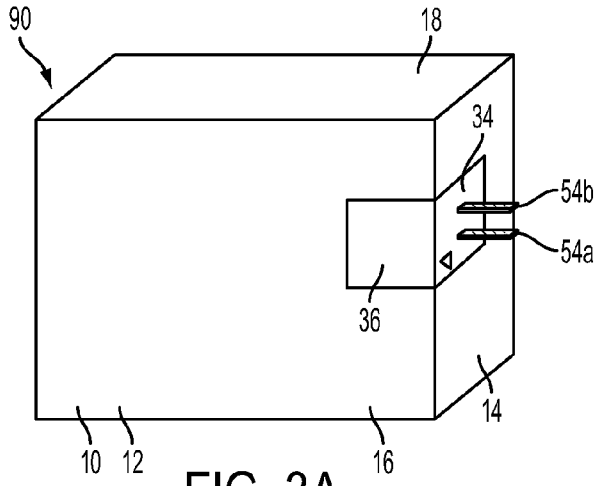
FIGS. 3A to 3E are perspective views illustrating repositioning the electrical plug from a first orientation to a second orientation relative to the power adapter.
Figure 3B:
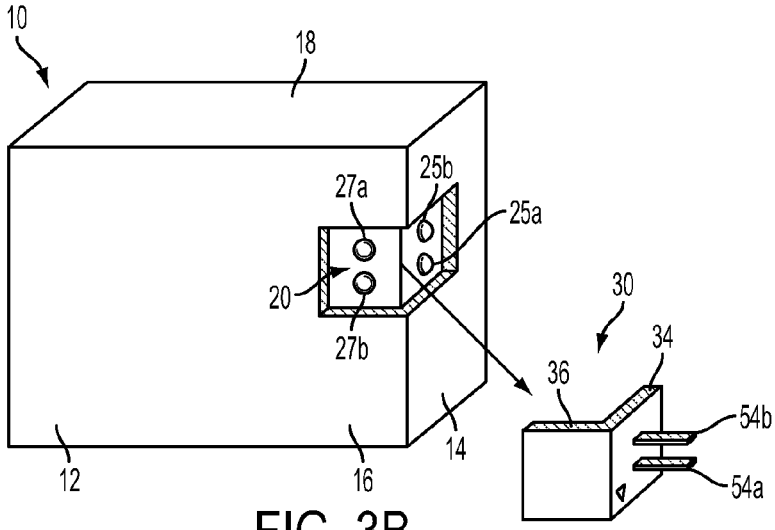
Figure 3C:
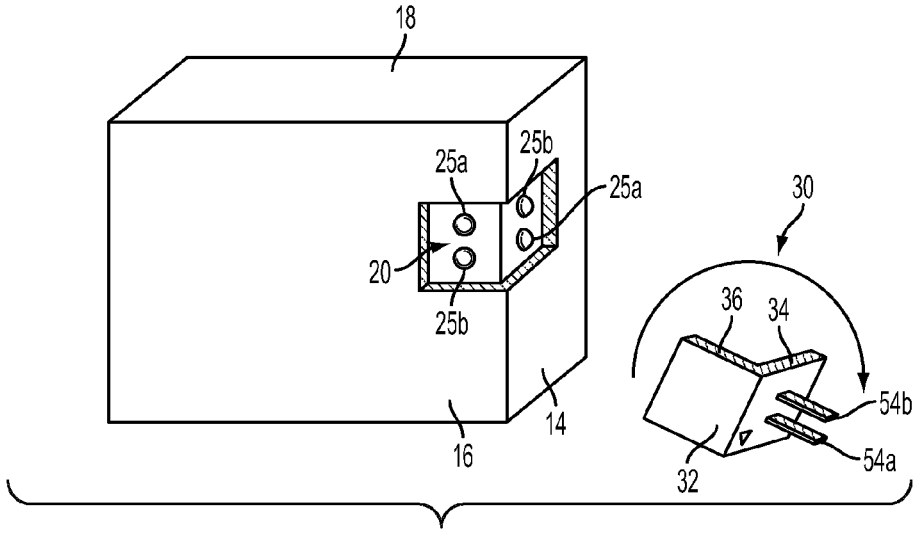
Figure 3D:
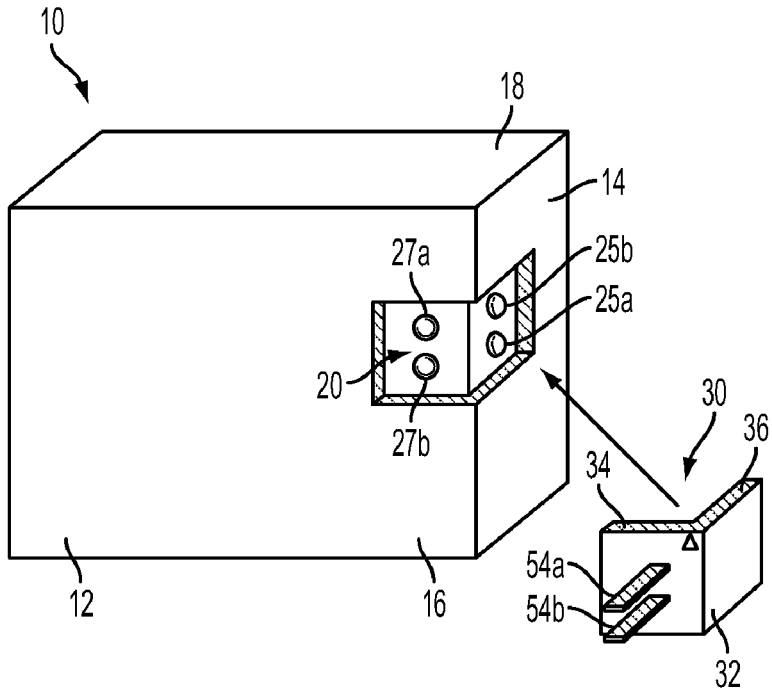
Figure 3E:
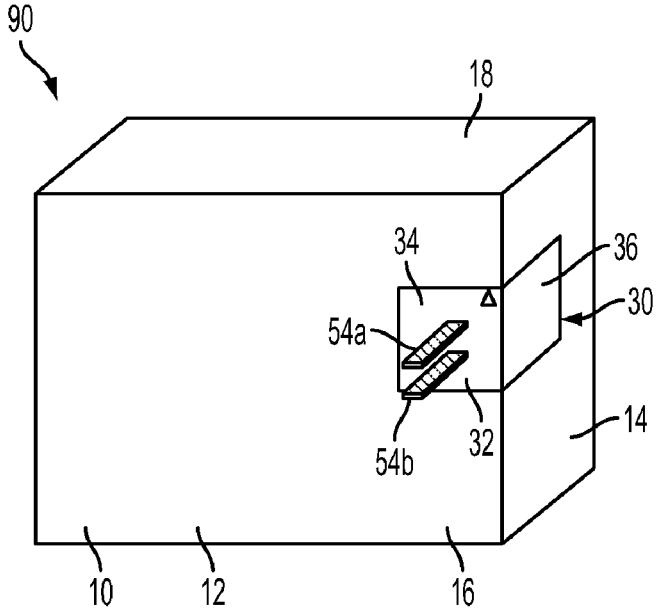

As shown in FIG. 3C, with the plug 30 uncoupled from the power adapter 10, the user rotates the plug 180 degrees. The user then couples the plug 30 to the power adapter 10 in the second orientation as shown in FIG. 3D. In some implementations, the plug 30 can be moved directly toward the edge 22 and placed in the cutout 20 to couple the plug 30 to the power adapter 10. In some implementations, the plug 30 slides along an axis (for example the first axis 80 or the second axis 82 of FIG. 1A) to be received in the cutout 20. The user presses the body 32 of the plug 30 into the cutout 20 to couple the plug 30 to the power adapter 10 in the second orientation, and the power adapter assembly 90 (FIG. 3E) can be connected to a power outlet to supply power to an electric device.

FIGS. 4A to 4F are cross-sectional views of various fastening mechanisms that can be used to couple an electrical plug to a power adapter. In some implementations, the engagement of the electrical contacts of a power adapter with recesses of the body of a plug can secure the plug to the power adapter. In addition, or alternatively, one or more fasteners such as rails, dovetail rails, tapers, clasps, clips, pins, straps, and snaps can secure a plug to a power adapter.

Figure 4A:
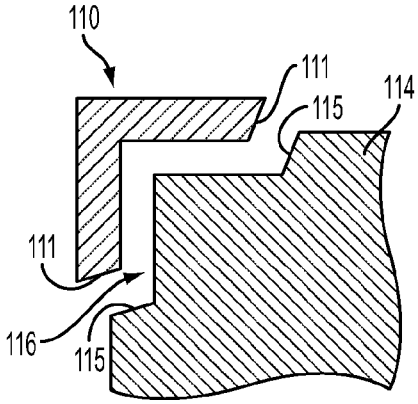
FIGS. 4A to 4F are cross-sectional views of various fastening mechanisms to couple an electrical plug to a power adapter.

Referring to FIG. 4A, a plug body 110 is coupled to a power adapter 114 by an interference fit (e.g., press fit). The body 110 includes tapered edges 111 that engage tapered edges 115 of the power adapter 114. As the body 110 is pressed into a cutout 116 in the power adapter 114, friction between the tapered edges 111, 115 holds the body 110 in place relative to the power adapter 114.

Figure 4B:
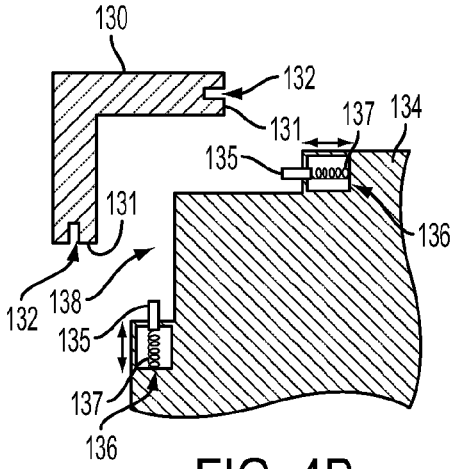

Referring to FIG. 4B, a plug body 130 is secured to a power adapter 134 by movable pins 135 in a cutout 138. The power adapter 134 includes pins 135 that move in a linear direction. Cavities 136 are defined in the power adapter 134, which allow the pins 135 to recede into the power adapter 134 when a force is applied against the pin 135. A spring 137 is coupled to each pin 135.

When the body 130 is brought toward the power adapter 134, ends 131 of the body 130 press the pins 135 into the cavities 136. This provides the body 130 clearance to move further into the cutout 138 while loading the springs 137. When the body 130 is received in the cutout 138, recesses 132 defined in the ends 131 of the body 130 align with the pins 135. The springs 137 cause the pins 135 to extend out of the cavities 136 and into the recesses 132. The pins 135, partially disposed in the recesses 132 and partially disposed in the power adapter 134, secure the body 130 to the power adapter 134. A sliding switch or other release mechanism (not shown) can be provided on the power adapter 134 to manually move the pins 135 into the power adapter 134, thus releasing the body 130.

Additional variations are also possible. For example, spring-loaded pins can be included in the body 130, and recesses to receive the pins can be included in the power adapter. Similarly, instead of pins, protruding edges can be received into channels. As another example, pins can be moved by other mechanisms other than springs. For example, a user can manipulate a control that causes pins to extend or retract from the power adapter 134 or from the body 130.

Figure 4C:
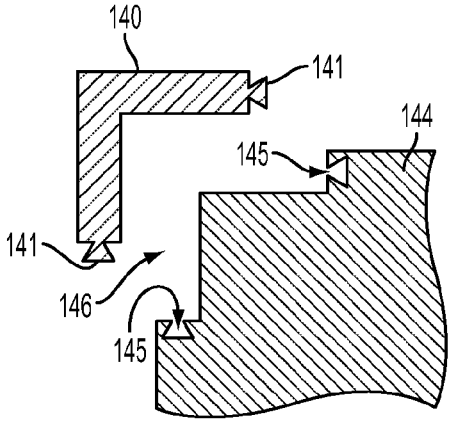
Figure 4D:
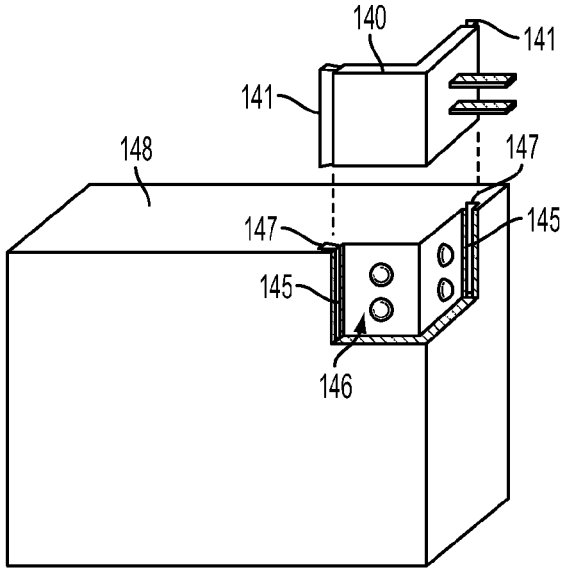

Referring to FIGS. 4C and 4D, a plug body 140 can include extensions 141, such as angled rails, that are received into channels 145 of a power adapter 144. The power adapter 144 defines entry points 147 that allow the extensions 141 to enter with the channels 145. For example, a cutout 146 that receives the body 140 can be defined through a surface 148 of the power adapter 144, permitting the extensions 141 to be placed in the channels 145 at the surface 148. The body 140 can slide into place, for example, in a linear motion, and the extensions 141 are received in the channels 145 to secure the body 140 to the power adapter 144.

Figure 4E:
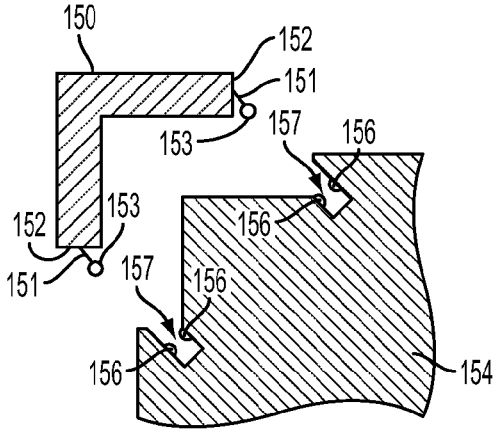

Referring to FIG. 4E, a plug body 150 includes extensions 151 disposed at approximately a 45 degree angle from end surfaces 152 of the body 150. The extensions 151 include a rounded end, such as a ball 153. The extensions 151 are received in sockets 155 defined in a power adapter 154. Each socket 155 includes one or more receiving members 156 that define an opening 157 slightly smaller than the width of the ball 153. As the body 150 is coupled to the power adapter 154, the balls 153 engage the receiving members 156, causing the receiving members 156 to flex or become displaced enough for the balls 153 to pass through. As the balls 153 pass between the receiving members 156, the receiving members 156 return to their original positions, narrowing the openings 157 to capture the balls 153 in the sockets 155. To remove the body 150 from the power adapter 154, the user can apply a force sufficient to flex or displace the receiving members 156 so that the balls 153 can leave the sockets 155, allowing the body 150 to become uncoupled from the power adapter 154.

Figure 4F:
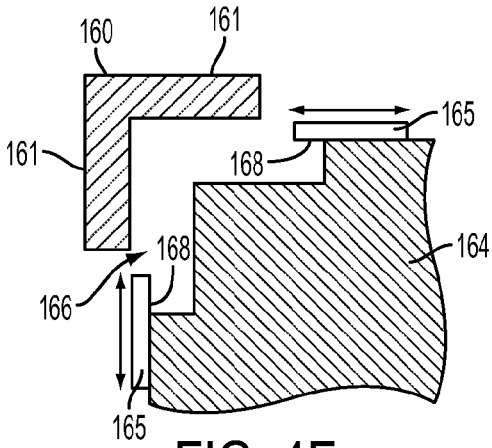

Referring to FIG. 4F, a plug body 160 is secured to a power adapter 164 by locks 165 that engage outer surfaces 161 of the body 160. The power adapter 164 defines a cutout 166 that receives the body 160. A user can move the locks 165 away from the cutout 166 to allow the body 160 to enter the cutout 166. For example, the locks 165 move in a linear direction parallel to sides 167 of the power adapter 164. In some implementations, the locks 165 can rotate, tilt, twist, recede into the power adapter 164, or otherwise move to allow the body 160 to enter the cutout 166. After the body 160 is received in the cutout 166, a user can move the locks 165 so that inner surfaces 168 of the locks 165 engage the outer surfaces 161 of the body 160, capturing the body 160 in the cutout 166. The locks 165 can be manually moved by the user, or can be moved in response to a user activating a control, such as a button or switch.

Figure 5B:
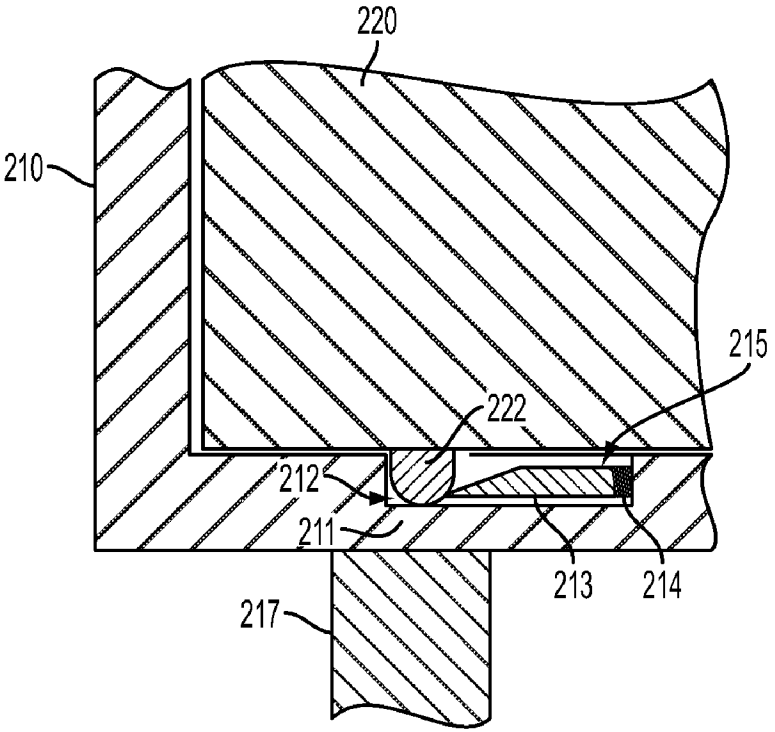
FIGS. 5A and 5B are cross-sectional views of a plug and a power adapter illustrating a safety mechanism.
Figure 5A:
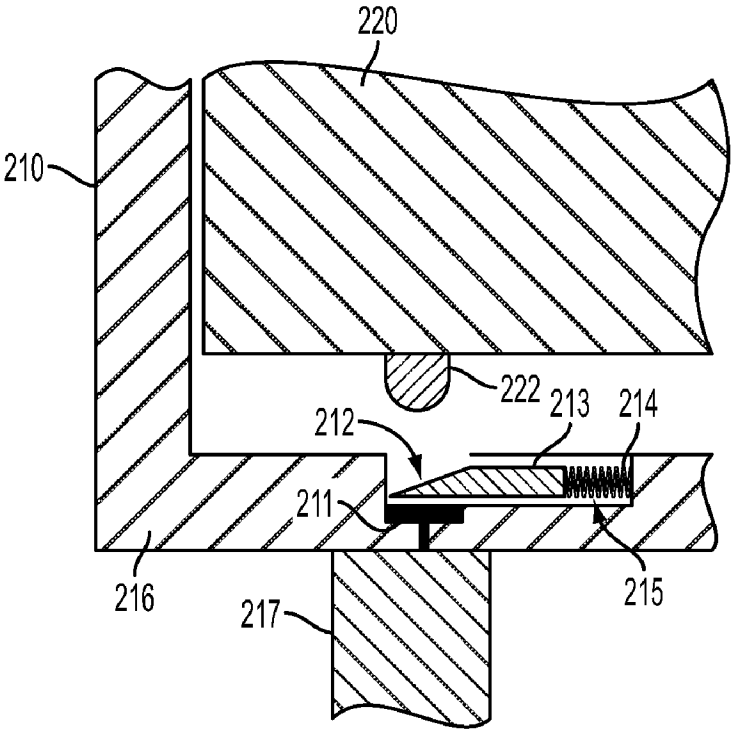

FIGS. 5A and 5B are cross-sectional views of a plug 210 and a power adapter 220 illustrating a safety mechanism. The safety mechanism includes a cover 213 that prevents accidental exposure to an electrical contact 211 of the plug 210 when the plug 210 is uncoupled from a power adapter 220.

The plug 210 includes a body 216 that defines a recess 212 and a compartment 215. The electrical contact 211 is disposed in the recess 212. The compartment 215 is open to the recess 212, so that the cover 213 can extend from the compartment 215 into the recess 212. The cover 213 covers the electrical contact 211 when the plug 210 is not coupled to the power adapter 220 (FIG. 5A), preventing a user from accidentally touching the electrical contact 211. A spring 214 presses the cover 213 into the recess 212.

When the plug 210 becomes coupled to the power adapter 220, an electrical contact 222 of the power adapter 220 enters the recess 212. The electrical contact 222 engages the cover 213 and moves the cover out of the recess 212 such that the cover 213 is received in the compartment 215. With the cover 213 moved out of the recess 212, the electrical contact 222 of the power adapter 220 can engage the electrical contact 211 of the plug 210 to establish an electrical connection with an electrical prong 217 of the plug 210. When the plug 210 is uncoupled from the power adapter 220, the spring 214 moves the cover 213 into the recess 212 to cover the electrical contact 211 of the plug 210.

Additional variations are possible. For example, the cover 213 can be retracted from the recess by mechanisms other than direct contact with the electrical contact 222. As another example, the electrical contacts located at different surfaces of a power adapter may not all be simultaneously connected to each other or to the adapter circuitry. As a result, AC power connected to electrical contacts at one surface of the power adapter may not expose AC power at electrical contacts located at different surface. If the body of the plug 210 breaks, some electrical contacts of the power adapter 220 (e.g., electrical contacts that are not positioned behind the electrical prongs) may become exposed. Nevertheless, when the exposed electrical contacts are not connected to the adapter circuitry, there is no danger to a user.

A power adapter 220 can include one or more switches that can connect electrical contacts of the power adapter 220 to and disconnect the electrical contacts from the adapter circuitry. For example, a pin extending from a surface of the plug 210 can engage a switch of the power adapter 220, causing the switch to connect a particular set of electrical contacts of the power adapter 220 to the adapter circuitry. Only the particular set of electrical contacts needed for the current orientation of the plug 210 can be connected to the adapter circuitry, while one or more other sets of electrical contacts of the power adapter 220 remain disconnected from the adapter circuitry for safety.

Figure 6A:
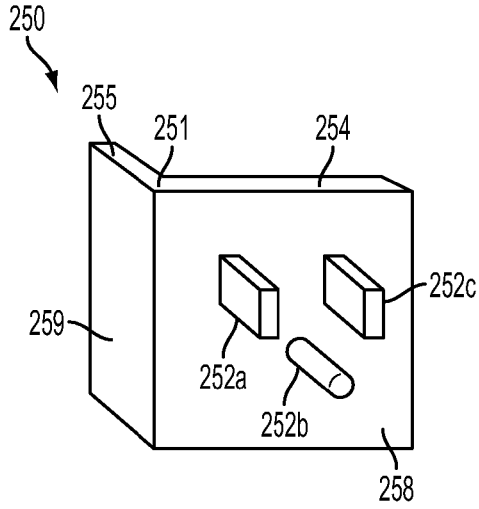
FIGS. 6A to 6C are respectively perspective, side, and perspective views of an alternative electrical plug.
Figure 6B:
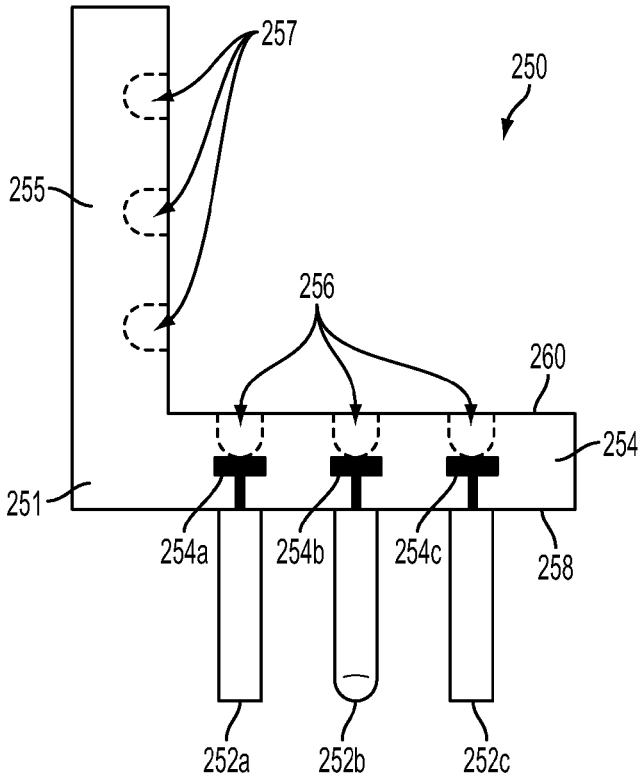
Figure 6C:
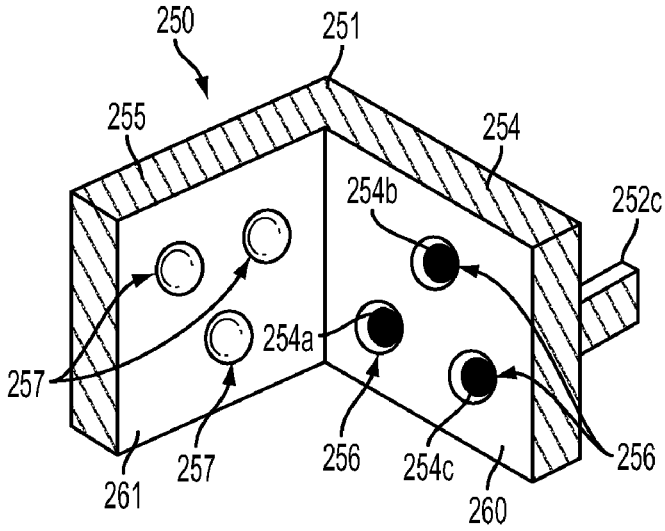
Figure 6D:
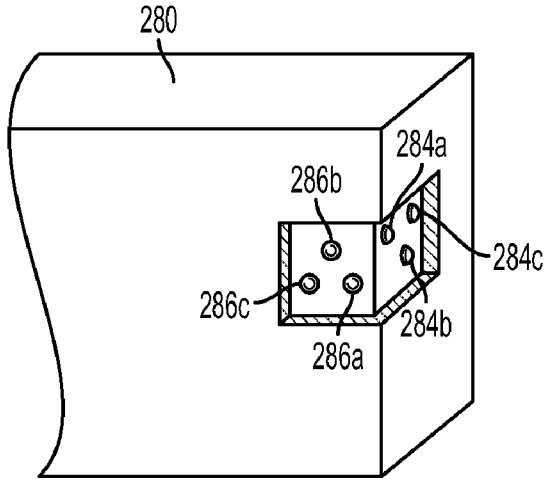
FIG. 6D is a perspective view of a power adapter that receives the electrical plug of FIG. 6A.

FIGS. 6A to 6C are respectively perspective, side, and perspective views of an alternative electrical plug 250. FIG. 6D is a perspective view of an alternative power adapter 280 that receives the electrical plug 250. The plug 250 includes three electrical prongs 252*a*-252*c*, permitting the electrical plug 250 to connect to two AC terminals and an electrically grounded terminal. Like the power adapter 10 and the plug 30 of FIGS. 1A and 1B, the plug 250 and the power adapter 10 can be coupled in at least two orientations.

The plug 250 includes a body 251 that includes a first portion 254 that is generally in the form of a rectangular plate. The first portion 254 extends in a plane from an edge of a second portion 255, which is also generally in the form of a rectangular plate. The second portion 255 extends in a plane generally perpendicular to the plane of the first portion 254. The first portion 254 includes an outer side 258 opposite an inner side 260. The second portion 255 includes an outer side 259 opposite an inner side 261.

Each electrical prong 252*a*-252*c* is electrically connected to a corresponding electrical contact 254*a*-254*c*. The electrical contacts 254*a*-254*c* are located in recesses 256, and recesses 257 are defined in the inner side 261. The recesses 256 and the recesses 257 are rotationally symmetrical such that the configuration of the recesses 256 and the recesses 257 is the same in their respective inner sides 260, 261 except for a 180-degree rotation.

The power adapter 280 includes first electrical contacts 284*a*-284*c* and second electrical contacts 286*a*-286*c* that are received in the recesses 256, 257. In a first orientation, the first electrical contacts 284*a*-284*c* are received in the recesses 256, and each contact 284*a*-284*c* connects electrically with one of the electrical contacts 254*a*-254*c* of the plug 250. In a second orientation, the second electrical contacts 286*a*-286*c* are received in the recesses 256, and each contact 286*a*-286*c* connects electrically with one of the electrical contacts 254*a*-254*c* of the plug 250.

Figure 7A:
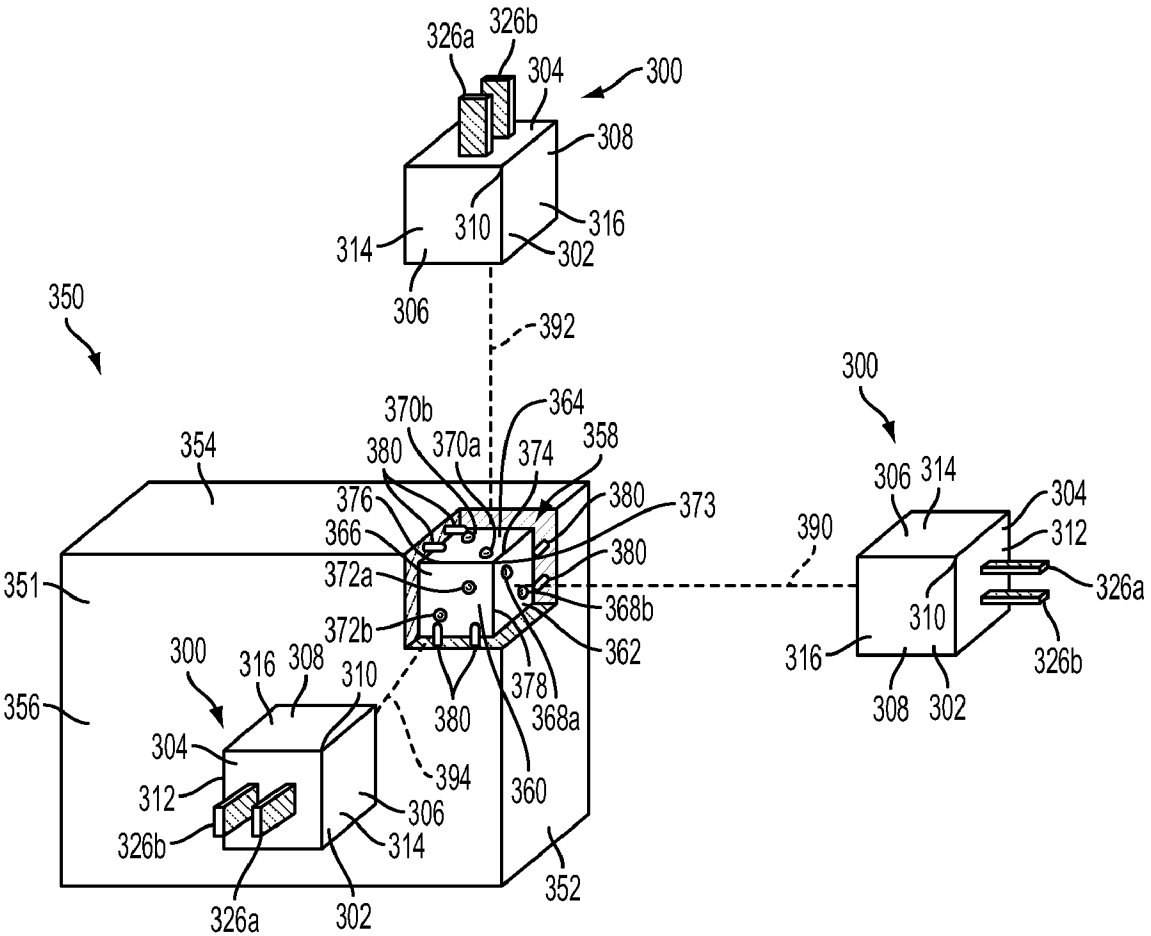
FIG. 7A is a perspective view of an alternative power adapter and an alternative electrical plug.
Figure 7B:
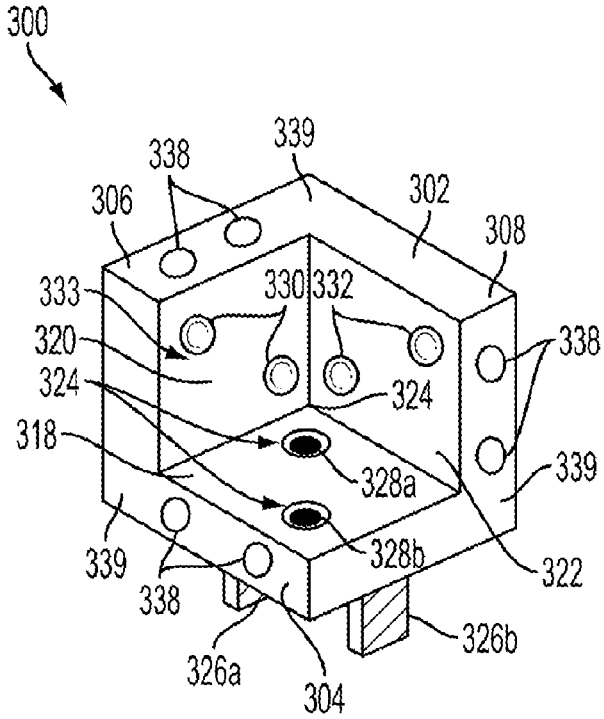
FIG. 7B is a perspective view of the electrical plug of FIG. 7A.

FIG. 7A is a perspective view of an alternative plug 300 and power adapter 350. FIG. 7B is a perspective view of the inside of the plug 300. The power adapter 350 receives the plug 300 in at least three orientations.

The plug 300 includes a body 302 with a first portion 304, a second portion 306, and a third portion 308. The first portion 304, the second portion 306, and the third portion 308 are each shaped as generally flat plates. The three portions 304, 306, 308 are oriented generally perpendicular to each other and meet at an exterior corner 310. The three portions 304, 306, 308 have respective outer surfaces 312, 314, 316 that form three adjacent faces of a cube. The three portions 304, 306, 308 also have respective inner sides 318, 320, 322 that meet at an interior corner 324 defined in the body 302.

The plug 300 includes electrical prongs 326*a*, 326*b* coupled to the outer surface 312 of the first portion 304. In the inner side 318 (opposite the surface 312 from which the electrical prongs 326*a*, 326*b* extend), the first portion 304 defines recesses 324. The plug 300 includes an electrical contact 328*a*, 328*b* disposed in each of the recesses 324. Each electrical contact 328*a*, 328*b* is electrically connected to one of the electrical prongs 326*a*, 326*b*. The recesses 324 and the electrical contacts 328*a*, 328*b* can be offset from the electrical prongs 326*a*, 326*b* and can be connected through the body 302 with wires or other conductors.

The second portion 306 defines recesses 330 through the inner side 320, and the third portion 308 defines recesses 332 through the inner side 322. The recesses 330, 332 do not have electrical contacts located within, but are configured to receive electrical contacts 368*a*, 368*b*, 370*a*, 370*b*, 372*a*, 372*b* of the power adapter 350.

The power adapter 350 includes a housing 351 that has a generally block-like shape and includes three generally perpendicular exterior sides 352, 354, 356. At a corner where the exterior sides 352, 354, 356 meet, the power adapter 350 defines a cutout 358 in which to receive the body 302 of the plug 300. Located in the cutout 358, the housing 351 includes a cube-shaped portion 360. The cube-shaped portion 360 is the selected to have generally the same size as a cube-shaped cutout 333 defined by the inner sides 318, 320, 322 of the body 302. As a result, the body 302 receives the cube shaped portion 360 in the cutout 333 of the body 302 when the cutout 358 receives the body 302 in the cutout 358 of the housing 351.

The cube-shaped portion 360 includes a first side 362, a second side 364, and a third side 366. Each of the sides 362, 364, 366 is generally flat and is perpendicular to the other two sides 362, 364, 366. First electrical contacts 368*a*, 368*b* are located at the first side 362, second electrical contacts 370*a*, 370*b* are located at the second side 364, and third electrical contacts 372*a*, 372*b* are located at the third side 366. The electrical contacts 368*a*, 368*b*, 370*a*, 370*b*, 372*a*, 372*b* each protrude from their respective sides 362, 364, 366.

The electrical contacts 368*a*, 368*b*, 370*a*, 370*b*, 372*a*, 372*b* are arranged symmetrically about a corner 373 of the cube-shaped portion 360. For example, the electrical contacts 368*a*, 368*b*, 370*a*, 370*b*, 372*a*, 372*b* are arranged with reflectional symmetry across: (i) a first edge 374, formed between the first side 362 and the second side 364; (ii) a second edge 376, formed between the second side 364 and the third side 366; and (iii) a third edge 378 formed between the third side 366 and the first side 362. The positions of any set of the electrical contacts 368*a*, 368*b*, 370*a*, 370*b*, 372*a*, 372*b* is a mirror image or reflection of the other electrical contacts 368*a*, 368*b*, 370*a*, 370*b*, 372*a*, 372*b* across any of the edges 374, 376, 378.

The recesses 324, 330, 332 are arranged with corresponding symmetry to match the positions of the electrical contacts 368*a*, 368*b*, 370*a*, 370*b*, 372*a*, 372*b*. As a result, when the plug 300 is coupled to the power adapter 350, each electrical contact 368*a*, 368*b*, 370*a*, 370*b*, 372*a*, 372*b* is received in one of the recesses 324, 330, 332.

The electrical contacts 368*a*, 368*b*, 370*a*, 370*b*, 372*a*, 372*b* are each connected to adapter circuitry within the housing 351. For example, the adapter circuitry receives electrical input from the first electrical contacts 368*a*, 368*b*, the second electrical contacts 370*a*, 370*b*, or the third electrical contacts 372*a*, 372*b*. In some implementations, the adapter circuitry receives electrical input simultaneously from a combination of the contacts 368*a*, 368*b*, 370*a*, 370*b*, 372*a*, 372*b*.

In some implementations, each of the contacts 368*a*, 370*a*, 372*a* are electrically connected together so that a voltage applied to the contact 368*a* is transmitted to the adapter circuitry and the contacts 370*a*, 372*a*, a voltage applied to the contact 370*a* is transmitted to the adapter circuitry and the contacts 368*a*, 372*a*, and a voltage applied to the contact 372*a* is transmitted to the adapter circuitry and the contacts 370*a*, 372*a*. Each of the contacts 368*b*, 370*b*, 372*b* is electrically connected together in a similar manner.

The body 302 of the plug 300 is received in the cutout 358 in at least three orientations. In the first orientation, the body 302 is aligned with the housing 351 along, for example, a first axis 390. Within the cutout 358, the inner side 318 of the body 302 engages the first side 362 of the housing 351 in the cutout 358. The first electrical contacts 368*a*, 368*b* are received in the recesses 324, and engage the electrical contacts 328*a*, 328*b* of the plug 300, establishing an electrically conductive connection. The electrical prongs 326*a*, 326*b* extend outward from the housing 351, perpendicular to the exterior side 352.

Also, in the first orientation, the electrical contacts 370*a*, 370*b* are covered by the second portion 306 and are received in the recesses 330, so that the inner side 320 of the body 302 engages the second side 364 of the housing 351. The electrical contacts 372*a*, 372*b* are covered by the third portion 308 and are received in the recesses 332, so that the inner side 322 engages the third side 366.

In the second orientation, the body 302 is aligned with the housing 351 along, for example, a second axis 392. Within the cutout 358, the inner side 318 of the body 302 engages the second side 364 of the housing 351. The second electrical contacts 370*a*, 370*b* are received in the recesses 324 and engage the electrical contacts 328*a*, 328*b* of the plug 300, establishing an electrically conductive connection. The electrical prongs 326*a*, 326*b* extend outward from the housing 351, perpendicular to the exterior side 354.

Also, in the second orientation, the first electrical contacts 368*a*, 368*b* are covered by the third portion 308 and are received in the recesses 332, so that the inner side 322 of the body 302 engages the first side 362 of the housing 351. The third electrical contacts 372*a*, 372*b* are covered by the second portion 306 and are received in the recesses 330, so that the inner side 320 engages the third side 366.

In the third orientation, the body 302 is aligned with the housing 351 along, for example, a third axis 394. Within the cutout 358, the inner side 318 of the body 302 engages the third side 366 of the housing 351. The third electrical contacts 372*a*, 372*b* are received in the recesses 324 and engage the electrical contacts 328*a*, 328*b* of the plug 300, establishing an electrically conductive connection. The electrical prongs 326*a*, 326*b* extend outward from the housing 351, perpendicular to the exterior side 356.

Also, in the third orientation, the first electrical contacts 368*a*, 368*b* are covered by the second portion 306 and are received in the recesses 330, such that the inner side 320 of the body 302 engages the first side 362 of the housing 351. The second electrical contacts 370*a*, 370*b* are covered by the second portion 306 and are received in the recesses 332, such that the inner side 322 engages the second side 364.

In each of the three orientations in which the plug 300 is coupled to the power adapter 350, the electrical prongs 326*a*, 326*b* extend perpendicular to different exterior sides 352, 354, 365 of the housing 351. Accordingly, the user can select a particular orientation is advantageous for a particular situation, for example, connecting the power adapter to a wall socket or a power strip. Each electrical contact 368*a*, 370*a*, 372*a* can be connected together, and each electrical contact 368*b*, 370*b*, 372*b* can be connected together, so that the polarity of the electrical connection with the electrical prongs is maintained during each of the three orientations.

The plug 300 can be coupled to the power adapter 350 by, for example, moveable extensions 380 can protrude from or be received in the housing 351. The extensions 380 can be located in the cutout 358. For example, the extensions 380 can extend from surfaces 382 in the cutout 358.

The body 302 of the plug 300 defines recesses 338 that receive the extensions 380. For example, the body 302 defines the recesses 338 in L-shaped surfaces 339 that are generally perpendicular to the inner surfaces 318, 320, and 322. The extensions 380 recede into the housing 351 to allow the body 302 to be positioned in the cutout 358. When the body 302 is located in the cutout 358, the extensions 380 extend from the housing 351 into the recesses 338, securing the plug 300 to the power adapter 350.

Figure 7C:
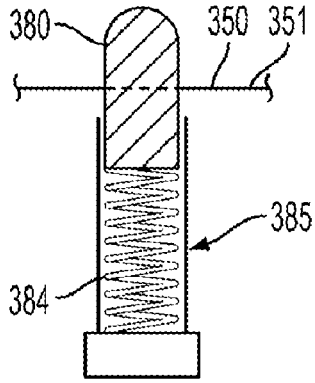
FIG. 7C is a side cutaway view of a portion of the power adapter of FIG. 7A illustrating a moveable extension of the power adapter.

FIG. 7C is a side cutaway view of a portion of the power adapter 350 illustrating a moveable extension 380 of the power adapter 350. The extension 380 can be coupled to a spring 384 located in a compartment 385. As the body 302 is received in the cutout 358, the body 302 presses the extension 380 into the compartment 385 and compresses the spring 384. When the body 302 is positioned so that one of the recesses 338 is positioned over the extension 380, the spring 384 presses the extension 380 into the recess 338 to secure the body 302 to the housing 351.

The extensions 380 can be refracted into the compartment 385 to allow the body 302 of the plug 300 to be removed from the power adapter 350. For example, the power adapter 350 can include a switch or other control that causes the extensions to retract.

Additional variations are possible. For example, the power adapter 350 can receive one of several different plugs, and each plug can have a different orientation of electrical prongs. For example, two different plugs can include electrical prongs that extend in the same direction from outer surfaces of the plugs, but the orientation of the electrical prongs of can vary so that the electrical prongs of one plug are oriented at a rotational offset, such as 90 degrees, compared to the other plug. As another example, different plugs can include different shapes and sizes of electrical prongs in order to function with electrical sockets in different countries. In some implementations, a single power adapter 350 can be used with multiple different types of electrical sockets by using a different electrical plug.

The electrical prongs of a plug can also be located at a rotatable face coupled to the body of the plug. The rotatable face can rotate in a plane parallel to an outer side of the plug, allowing the orientation of the electrical prongs of the plug to change relative to an outer side of the plug. For example, the rotatable face can rotate up to 90 degrees, 180 degrees, 270 degrees, 360 degrees or more.

Plugs can include one, two, three or more electrical prongs, and plugs can include one, two, three or more electrical contacts. The electrical contacts of the power adapter can be arranged to connect to one or more electrical contacts of any of several different plugs. Some plugs may not establish an electrical connection with all of the electrical contacts located at a particular surface of a power adapter. Likewise, some power adapters may not establish an electrical connection with all of the electrical contacts located at a particular surface of a plug.

In some implementations, there are no recesses defined in inner surfaces of the plugs. For example, electrical contacts of a plug can be disposed on one or more inner sides and can be flush with the inner sides or can protrude from the inner sides. Accordingly, a power adapter can establish an electrical connection with electrical contacts of the plug with electrical contacts that are positioned flush with surfaces of the power adapter or recessed into the power adapter.

Particular implementations have been described. Other implementations are within the scope of the following claims. For example, the steps recited in the claims can be performed in a different order and still achieve desirable results.

What is claimed is:

1. An electrical adapter assembly comprising:

a housing defining a cutout, the housing comprising first electrical contacts, second electrical contacts and third electrical contacts disposed within the cutout; and a plug comprising a body having a first portion extending from an edge of a second portion, the first portion extending generally orthogonal to the second portion, electrical prongs extending from the first portion, and electrical contacts coupled to the electrical prongs, the body of the plug being receivable in the cutout in at least three orientations, and in each of the at least three orientations, one or more of the electrical contacts of the plug engage at least one of the first electrical contacts, at least one of the second electrical contacts or at least one of the third electrical contacts, wherein in the first orientation, the electrical prongs extend in a direction orthogonal to the first side of the housing, in the second orientation, the electrical prongs extend in a direction orthogonal to a second side of the housing, and in the third orientation, the electrical prongs extend in a direction orthogonal to the third side of the housing.

2. The electrical adapter assembly of claim 1, wherein the electrical prongs extend outward from the housing when the body of the plug is received in the cutout.

3. The electrical adapter assembly of claim 1, wherein the at least two orientations include a first orientation and a second orientation, wherein in the first orientation, the electrical contacts of the plug establish an electrical connection with the first electrical contacts and the second portion of the body of the plug is disposed over the second electrical contacts, and wherein in the second orientation, the electrical contacts of the plug establish an electrical connection with the second electrical contacts and the second portion of the body of the plug is disposed over the first electrical contacts.

4. The electrical adapter assembly of claim 1, wherein:

the body of the plug includes a third portion extending generally orthogonal to the first portion and the second portion;

the housing further comprises third electrical contacts disposed within the cutout; and the body of the plug is receivable in the cutout in at least three orientations, and in each of the at least three orientations, one or more of the electrical contacts of the plug engage at least one of the first electrical contacts, at least one of the second electrical contacts, or at least one of the third electrical contacts.

5. The electrical adapter assembly of claim 4, wherein the at least three orientations include a first orientation, a second orientation, and a third orientation, wherein in the first orientation, the electrical contacts of the plug establish an electrical connection with the first electrical contacts, the second portion of the body is disposed over the second electrical contacts, and the third portion of the body is disposed over the third electrical contacts, wherein in the second orientation, the electrical contacts of the plug establish an electrical connection with the second electrical contacts, the second portion of the body is disposed over the third electrical contacts, and the third portion of the body is disposed over the first electrical contacts, and wherein in the third orientation, the electrical contacts of the plug establish an electrical connection with the third electrical contacts, the second portion of the body is disposed over the first electrical contacts, and the third portion of the body is disposed over the second electrical contacts.

6. A power adapter comprising:

a housing defining a cutout, the housing having a first surface disposed within the cutout, a second surface disposed within the cutout, and a third surface disposed within the cutout, the first surface being generally orthogonal to the second surface and to the third surface;

first electrical contacts disposed at the first surface;

second electrical contacts disposed at the second surface, third electrical contacts disposed at the third surface;

wherein the housing is configured to receive a body of a plug in the cutout in at least three orientations such that in each of the at least three orientations, an electrically conductive connection is established with the plug and at least one of the first electrical contacts in the first orientation, the second electrical contacts in the second orientation or the third electrical contacts in the third orientation;

wherein in the first orientation, electrical prongs of the plug extend in a direction orthogonal to the first side of the housing, in the second orientation, the electrical prongs extend in a direction orthogonal to a second side of the housing, and in the third orientation, the electrical prongs extend in a direction orthogonal to the third side of the housing.

7. The power adapter of claim 6, further comprising adapter circuitry located in the housing, wherein the adapter circuitry is configured to receive electrical input from both the first electrical contacts and the second electrical contacts.

8. The power adapter of claim 6, wherein the first electrical contacts and the second electrical contacts are electrically connected such that voltages applied to the first electrical contacts are transmitted to the second electrical contacts, and voltages applied to the second electrical contacts are transmitted to the first electrical contacts.

9. The power adapter of claim 6, wherein the first electrical contacts protrude from the first surface and the second electrical contacts protrude from the second surface.

10. The power adapter of claim 6, wherein the cutout is defined in a corner of the housing.

11. The power adapter of claim 6, wherein the housing includes a cube-shaped portion disposed in the cutout, the cube-shaped portion including the first surface, the second surface, and a third surface oriented orthogonal to the first surface and the second surface.

12. The power adapter of claim 6, wherein:

the housing has a third surface disposed within the cutout, the third surface being generally orthogonal to the first surface and the second surface;

the power adapter further comprises third electrical contacts disposed at the third surface; and the housing is configured to receive a body of a plug in the cutout in at least three orientations such that in each of the at least three orientations, an electrically conductive connection is established between the plug and at least one of the first electrical contacts, at least one of the second electrical contacts, or at least one of the third electrical contacts.

13. An electrical plug comprising:

a member having a first portion extending from an edge of a second portion, the first portion extending generally along a first plane and the second portion extending along a second plane generally orthogonal to the first plane, the first portion having a first side and a second side opposite the first side and a third portion extending from an edge of the first portion and a second edge of the second portion, the third portion extending along a third plane generally orthogonal to the first plane and the second plane, wherein the third portion has a first side and a second side opposite the first side and defines one or more recesses;

electrical prongs coupled to the first side of the first portion; and electrical contacts on the second side coupled to the electrical prongs.

14. The electrical plug of claim 13, wherein the first portion defines one or more first recesses, and the second portion defines one or more second recesses having approximately the same dimensions as the first recesses, and wherein the electrical contacts are disposed in the first recesses or the second recesses.

15. The electrical plug of claim 14, wherein the second portion has a first side and a second side opposite the first side, the second side of the first portion and the second side of the second portion generally forming a right angle, wherein the first recesses are defined in the second side of the first portion and the second recesses are defined in the second side of the second portion.

16. The electrical plug of claim 14, wherein the body defines an edge where the second side of the first portion meets the second side of the second portion, and wherein the first recesses and the second recesses are defined with symmetry across the edge.

17. The electrical plug of claim 13, further comprising a moveable cover configured to cover the electrical contacts when the electrical plug is not coupled to a power adapter, and configured to not cover the electrical contacts when the electrical plug is coupled to a power adapter.

18. The electrical plug of claim 13, wherein:

the first portion defines one or more first recesses, and the second portion defines one or more second recesses having approximately the same dimensions as the first recesses, and the one or more third recesses having approximately the same dimensions as the first recesses;

the electrical contacts are disposed in the first recesses, the second recesses, or the third recesses; and the first recesses, the second recesses, and the third recesses are defined with symmetry across one or more edges, the edges being defined between any two of the second side of the first portion, the second side of the second portion, and the second side of the second portion.

* * * * *